United States Patent [19]

Knickerbocker

[11] 4,328,911

[45] May 11, 1982

[54] CHILD RESISTANT AEROSOL ACTUATING OVERCAP

[75] Inventor: Michael G. Knickerbocker, Crystal Lake, Ill.

[73] Assignee: Seaquist Valve Company, Cary, Ill.

[21] Appl. No.: 171,357

[22] Filed: Jul. 23, 1980

[51] Int. Cl.[3] ..... B65D 83/14; B65D 55/12

[52] U.S. Cl. ..... 222/182; 222/402.11; 222/402.13

[58] Field of Search ..... 222/153, 182, 402.11, 222/402.13, 402.21, 402.22, 509, 47, 48

[56] References Cited

U.S. PATENT DOCUMENTS

| | | | |
|---|---|---|---|
| 2,573,624 | 10/1951 | Svendsen | 222/402.11 X |
| 3,058,626 | 10/1962 | Hibbs et al. | 222/402.13 X |
| 3,107,033 | 10/1963 | Sanborn | 222/402.13 X |
| 3,138,331 | 6/1964 | Kutik | 222/402.11 X |
| 3,734,354 | 5/1973 | Gach | 222/402.11 X |
| 3,967,760 | 7/1976 | Marcon | 222/402.11 X |
| 4,024,995 | 5/1977 | Landen et al. | 222/402.11 |
| 4,254,899 | 3/1981 | Van Lit | 222/402.13 |

*Primary Examiner*—David A. Scherbel
*Attorney, Agent, or Firm*—Frijouf, Rust & Pyle

[57] ABSTRACT

A child resistant assembly is disclosed comprising an actuator button having a terminal orifice connected through a valve stem to a valve for enabling discharge of the aerosol product from the terminal orifice upon opening the valve. An overcap is rotatably secured to the aerosol container and includes a finger actuator movably mounted relative to the overcap. A non-symmetrical surface is disposed on either the actuator button or the finger actuator for cooperation with an engaging surface on the other of the actuator button and the finger actuator. The engaging surface engages the non-symmetrical surface for transferring the finger movement of the operator to open the valve only upon a selected orientation of the finger actuator relative to the actuator button. The engaging surface fails to contact the non-symmetrical surface upon finger movement of the operator when the finger actuator is in a non-selected orientation relative to the actuator button.

14 Claims, 29 Drawing Figures

CHILD RESISTANT AEROSOL ACTUATING OVERCAP

BACKGROUND OF THE INVENTION

1. Field of the Invention

This invention relates to aerosol products and containers and more particularly to child resistant assemblies for preventing accidental discharge of the aerosol products by children.

2. Description of the Prior Art

Various types of child proof and child resistant containers bottles, jars and aerosol actuators have been developed in the prior art in an effort to reduce the number of accidental openings and/or discharges of containers by small children. Those skilled in the prior art will appreciate the sophistication and complexity of many of these child proof containers and/or actuators and the substantial effort expended in the development thereof. It is a prime objective for all of these closures and actuators to provide a simple, efficient and economical child proof container which may be easily operated by adults or elderly persons while simultaneously being substantially inoperative for a small child.

Many child resistant assemblies have been devised specifically for use with an aerosol products. In a child proof aerosol product, a container is filled with a product and a propellant under pressure to be released upon activation of an aerosol valve. In general, a movement of skill such as aligning component parts or a finger of adult size is required to activate the aerosol valve. The use of additional structural elements to provide the movement of skill or to sense the size of the adult finger adds to the complexity of the aerosol product which inhibits the acceptance in the market. The additional parts or components required to make the child proof aerosol container add to both the material cost and the assembly cost of the child proof aerosol container.

In general, the assembly of the component parts of a child resistant aerosol container requires a preferred orientation of the parts during the assembly process. Accordingly, it is more costly to assemble a child resistant assembly since the parts must be positioned in a preferred orientation to properly complete the assembly.

A further requirement of most child resistant aerosol containers is the capability for use with conventional aerosol containers and conventional aerosol valves. With these severe restrictions and limitations, it can be appreciated by those skilled in the art that a simple and efficient child resistant container has not been developed by the prior art at a reasonable price.

Therefore it is an object of this invention to provide a child resistant assembly which overcomes the inadequacies of the prior art and provides a substantial contribution to the child resistant assemblies for aerosol containers.

Another object of this invention is to provide a child resistant assembly for use with an aerosol container which may be assembled with the same number of component parts as a conventional aerosol container.

Another object of this invention is to provide a child resistant assembly for an aerosol container wherein the component parts may be assembled without concern for the orientation of the component parts.

Another object of this invention is to provide a child resistant assembly for an aerosol container utilizing an aerosol overcap having a finger actuator wherein the overcap is rotatably mounted on the container relative to an actuator button for allowing activation of the aerosol valve only upon a selected orientation between the overcap and the actuator button.

Another object of this invention is to provide a child resistant assembly for an aerosol container compatible for use with either a tilt valve which discharges aerosol product upon tilting the valve or for use with a vertical action valve which discharges aerosol product upon a vertical depression of the valve stem.

Another object of this invention is to provide a child resistant assembly for an aerosol container comprising a non-symmetrical means cooperable with an engaging surface whereby the valve may be actuated by the operator upon a selected orientation between the non-symmetrical means and the engaging surface.

Another object of this invention is to provide a child resistant assembly for aerosol containers for use with standard industry aerosol containers and valves.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a child resistant assembly for use with an aerosol container having a valve for discharging aerosol products upon moving the valve. The assembly comprises an actuator button having a terminal orifice. A valve stem connects the actuator with the valve for enabling discharge of the aerosol product from the terminal orifice upon opening the valve. An overcap is secured to the aerosol container for at least partially covering the actuator button. A finger actuator is movably mounted relative to the overcap for cooperation with the actuator button. An engaging surface is disposed on either the actuator button or the finger actuator for cooperation with non-symmetrical means on the other of the actuator button and finger actuator. Means are provided for rotationally mounting the finger actuator relative to the actuator button for enabling the engaging means to contact the non-symmetrical means upon finger movement of the operator to open the valve only upon a selected orientation of the finger actuator relative to the actuator button.

In more specific embodiments of the invention, the finger actuator is pivotably mounted to the overcap with the pivot axis being displaced from the axis of the valve for moving the valve when the engaging surface contacts the non-symmetrical means.

The engaging surface may comprise projection means disposed for engaging the non-symmetrical means upon finger movement of the operator during a selected orientation of the finger actuator relative to the actuator button. The engaging surface avoids the non-symmetrical means upon finger movement of the operator during non-selected orientation of the finger actuator relative to the actuator button. The non-symmetrical means and the finger actuator may take various forms within the embodiments of the invention. In one embodiment, the non-symmetrical means comprises protuberance means extending from either the actuator button or the finger actuator for providing a non-symmetrical dimension about the axis of the valve. The projections may comprise plural spaced apart projections for engaging the protuberance means upon a selected orientation between the finger actuator and the actuator button. The plural projections receive the protuberances therebetween upon a non-selected orientation of the finger actuator and the actuator button.

The finger actuator is preferably an integral member with the overcap and being pivotably mounted through an integral hinge. The engaging surface may be disposed on the finger actuator with the non-symmetrical means comprising the outer configuration of the actuator button. The non-symmetrical means may also comprise the outer configuration of the actuator button with the engaging surfaces extending from the underside of the finger actuator.

The protuberance extends from the actuator button for cooperation with the projections extending from the underside of the finger actuator. It should be understood that the projection and protuberances may be interchanged in accordance with the practice of this invention. The structure finds usefulness in both the vertical and horizontal overcaps with both a tilt and a vertical actuated valve. In another embodiment of the invention, a projection extending from the underside of the finger actuator cooperates with the protuberance extending upwardly from the actuator button. When selected orientation is established between the finger actuator and the actuator button, depression of the finger actuator vertically depresses the valve stem to discharge propellant and product. In a non-selected orientation, the projection is stopped prior to engagement with the actuator button thus inhibiting discharge of product and propellant from the aerosol container.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized on a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
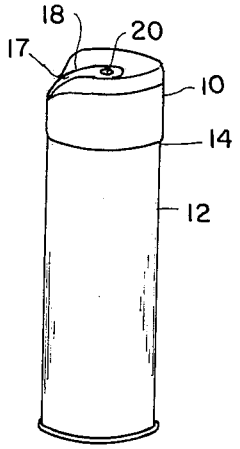
FIG. 1 is a side elevational view of a child resistant assembly incorporated into a vertical spray assembly.
Figure 2:
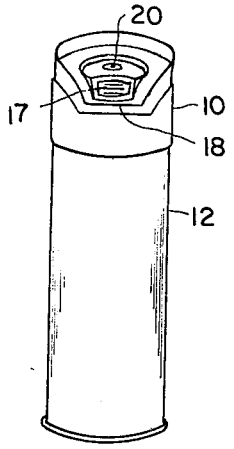
FIG. 2 is a rear elevational view of the assembly shown in FIG. 1.
Figure 23:
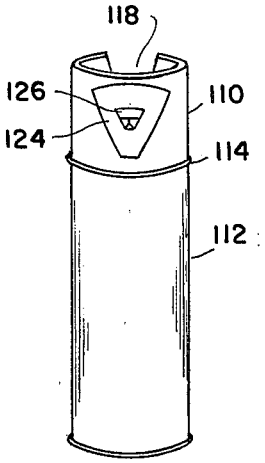
FIG. 23 is an elevational view of a child resistant assembly incorporated into a horizontal overcap.
Figure 24:
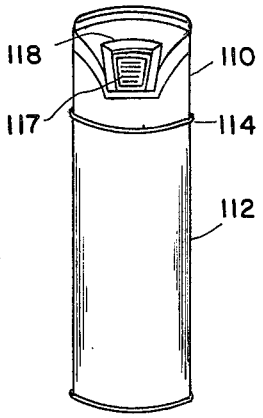
FIG. 24 is a rear elevational view of FIG. 23.

FIG. 1 is a side perspective view of the child resistant overcap 10 disposed on an aerosol container 12 containing a propellant and a product. In this embodiment, the child resistant overcap 10 is affixed to an upper rim 14 of the aerosol container 12. The overcap 10 covers an actuator button 15 having a terminal orifice 16 shown in FIGS. 3 and 4 with a finger actuator 17 disposed adjacent a finger recess 18 in the overcap 10. An aperture 20 is disposed in the finger actuator 17 for enabling a vertical spray to be discharged substantially along the axis of symmetry of the aerosol container 12. It will be appreciated from the following description that the invention may be suitable for use with either a vertical overcap as shown in FIGS. 1 and 2 or a horizontal overcap as shown in FIGS. 23 and 24 or other angular positions therebetween such as a forty five degree angle spray or the like. It should also be understood that the overcap 10 may be secured to other surfaces of the aerosol container 12 including but not limited to the inside or outside rim of the container 12 or the inside or outside rim of the mounting cup or other means.

Figure 3:
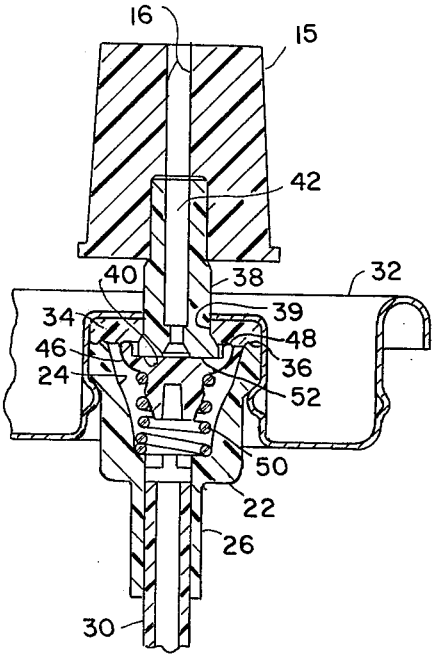
FIG. 3 is an enlarged side sectional view of a valve for use with the overcap of the assembly shown in FIG. 1 in the unattended position.
Figure 4:
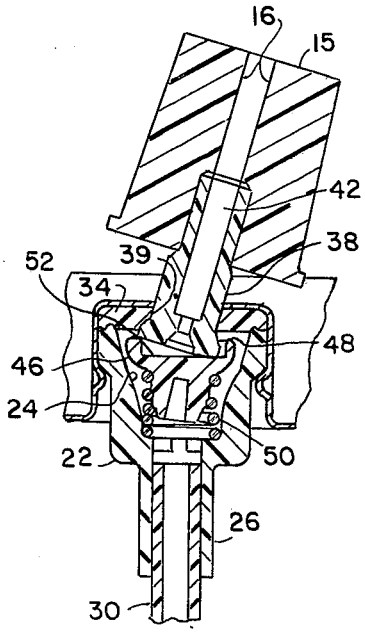
FIG. 4 is a side sectional view similar to FIG. 3 with the valve being shown in a tilted position.
Figure 21:
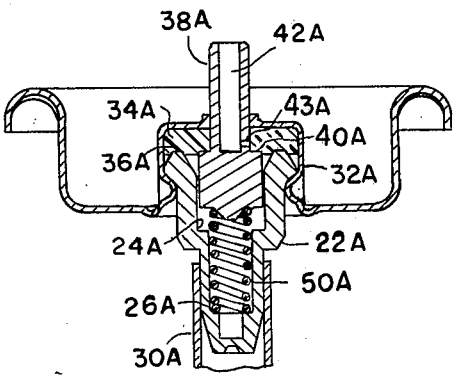
FIG. 21 is a side sectional view of a vertical actuator valve in an unattended position which is suitable for use with the present invention.
Figure 22:
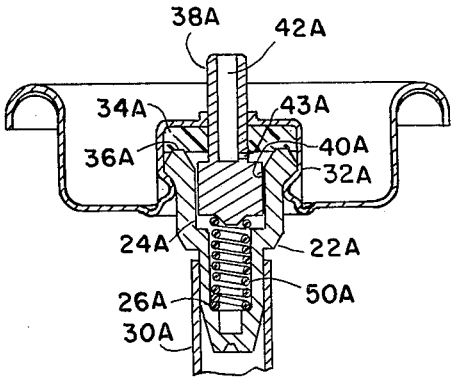
FIG. 22 is a side sectional view of the valve of FIG. 21 in the opened position.

FIGS. 3 and 4 illustrate a tilt valve assembly which is suitable for use with the invention set forth herein. A vertical actuator valve is also suitable for use with the present invention as shown in FIGS. 21 and 22. The valve assembly is generally indicated as a tilt valve and includes a valve body 22 having a body cavity 24 formed on the interior thereof. A tail portion 26 is integrally attached or otherwise connected to the valve body 22 and is attached to a dip tube 30. The dip tube 30 is disposed in fluid communication between the interior of the aerosol container 12 and the body cavity 24.

The valve body 22 is mounted to a conventional mounting cup 32 with a sealing gasket 34 disposed in sealing engagement about the upper periphery 36 of the valve body 22. A valve stem 38 having a flat base portion 40 extends through a gasket aperture 39 to allow relative free movement of the base 40 of the valve stem 38 as will be explained in greater detail hereinafter. The stem 38 has a through aperture 42 extending between the substantially flat base 40 and the actuator button 15. A valve stem sealer 46 is disposed within the body cavity 24 with the upper periphery 48 of the valve stem sealer being biased by spring 50 to form a first seal with the sealing gasket 34.

The substantially flat base portion 40 of the valve stem is supported on a substantially flat platform 52 of the valve stem sealer 46. The cooperation of the flat base 40 and the flat platform 52 provides a second seal to prevent propellant and product from issuing from the dip tube 30 to the valve stem 38. The novel valve design shown in FIGS. 3 and 4 will not open to discharge product and propellant upon a vertical depression of the valve stem, but will open only upon a tilt or a toggle action of the valve stem 38. A vertical movement of the valve stem 38 in FIG. 3 disengages the upper periphery 48 of the valve stem sealer 46 from the gasket 34 but a second seal is still maintained between the flat base 40 and the flat platform 52.

FIG. 4 illustrates the tilting of the valve wherein the tilted valve stem 38 enables the upper periphery 48 to disengage from the sealing gasket 34 while the flat base 40 disengages with the flat platform 52. The product and propellant flows from dip tube 30 around the upper periphery 40 of the valve stem sealer 46 and through aperture 42. As the invention will be set forth therein, it will be made obvious that the present contribution to the art may utilize the disclosed tilt valve of FIGS. 3 and 4 as well as conventional tilt valves or vertical actuator valves such as shown in FIGS. 21 and 22 or the equivalent.

An important aspect of the present invention resides in an engaging surface disposed on either the actuator button or the finger actuator for cooperation with non-symmetrical means and the other of the actuator button or the finger actuator. In this specification, the term "non-symmetrical" refers to a non-symmetric symmetry relative to an axis extending through the valve stem 38. In the embodiment shown in FIGS. 5–8, the non-symmetrical means is disposed on the actuator button and the engaging surface disposed on the finger actuator. More specifically, the actuator button 15 comprises plural projections 54 extending outwardly from the upper sides of the actuator button 15. The engaging surface 56 is located on a protuberance 58 extending below the finger actuator 17 and on either side of the aperture 20.

Figure 5:
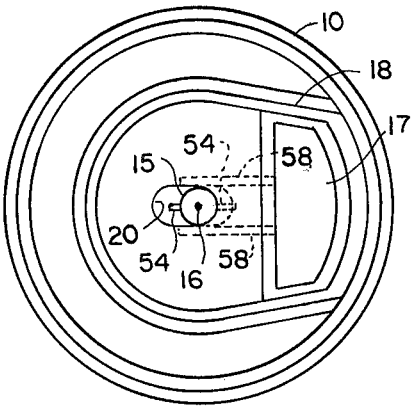
FIG. 5 is a plan view of a first embodiment of the child resistant assembly with the overcap shown in a non-selected orientation.

FIG. 5 illustrates a non-selected orientation between the button 15 and the overcap 10 wherein the projections 54 are aligned parallel to the protuberances 58.

Figure 6:
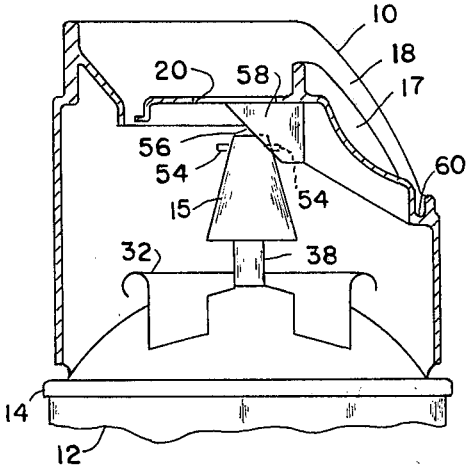
FIG. 6 is a side view of FIG. 5.

FIG. 6 illustrates the result of depression of the finger actuator 17 when the actuator button 15 and the finger actuator 17 are in the non-selected orientation as shown in FIG. 5. The engaging surfaces 56 avoids contact with the projections 54 or any other portion of actuator button 15 and thus fails to move or open the valve. In the non-selected orientation, the engaging surface fails to contact the actuator button to reduce the risk of accidental discharge of product and propellant from the container by a child.

Figure 7:
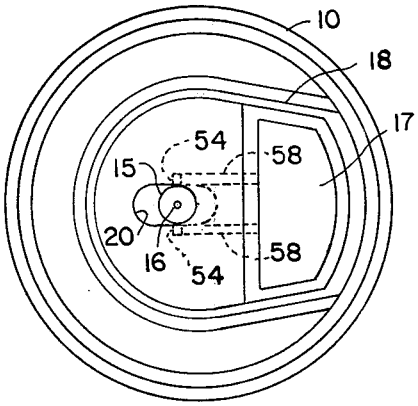
FIG. 7 is a plan view of the assembly shown in FIG. 4 with the overcap shown in a selected orientation.

FIG. 7 illustrates a plan view of the child resistant assembly shown in FIGS. 5 and 6 in the selected orientation of the finger actuator relative to the actuator button 15. It is evident that the overcap 10 has been rotated ninety degrees relative to the container to align the projections 54 to be perpendicular to and in interruptive relationship with the engaging surface 56.

Figure 8:
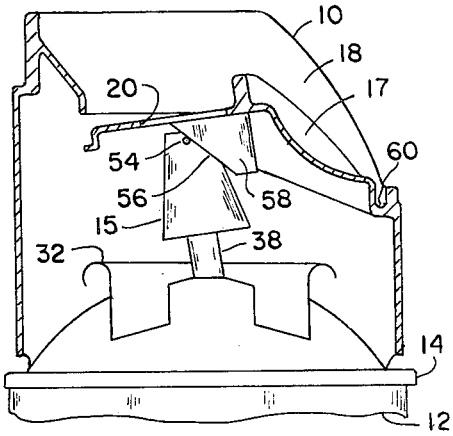
FIG. 8 is a side view of FIG. 7.

FIG. 8 illustrates the result of depression of the finger actuator 17 in the selected orientation shown in FIG. 7. The engaging surface 56 contacts the projections 54 thereby transferring movement of the finger actuator 17 to tilt the valve stem 38 to discharge product and propellant from the terminal orifice 16 through the aperture 20 in the finger actuator 17. In the selected orientation as shown in FIGS. 7 and 8, the vertical overcap funtions as a conventional overcap spray assembly. It should be appreciated that the disclosed overcap is a one-piece assembly with an integral hinge 60 interconnecting the overcap with the finger actuator 17. Preferably, the actuator button 15 and the projections 54 are an integral one-piece unit thus requiring only the identical number of component parts as the prior art non-child proof overcap assemblies.

It should be clear that the invention resides in the cooperation of a non-symmetrical means and an engaging surface disposed on either the finger actuator or the actuator button. This enables discharge of product and propellant only upon the selected or desired orientation therebetween. A non-selected orientation results in the engaging surface avoiding contact with the projection on either the finger actuator or the actuator button. Once the first embodiment of this invention is made apparent, it will be clear that numerous other embodiments can be readily constructed in accordance with the basic teaching of the embodiment shown in FIGS. 5–8. Accordingly, the following embodiments show various variations of the invention but it should be understood that numerous other variations may be developed through the practice and teaching of this invention.

Figure 9:
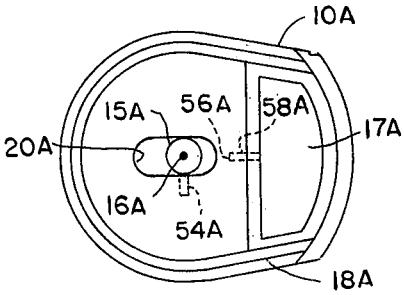
FIG. 9 is a plan view of a second embodiment of the child resistant assembly shown in a non-selected orientation.
Figure 11:
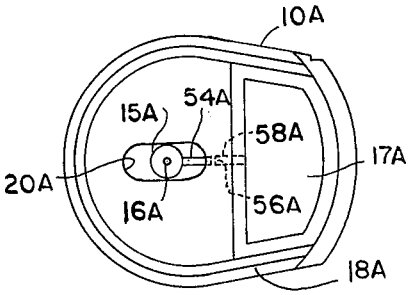
FIG. 11 is a plan view of the assembly shown in FIG. 9 with the overcap shown in a selected orientation.
Figure 10:
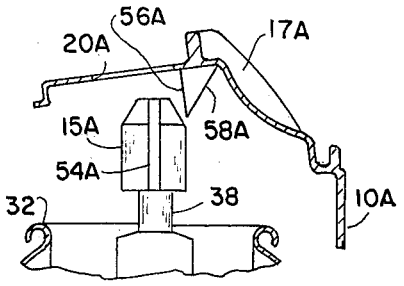
FIG. 10 is a side view of FIG. 9.
Figure 12:
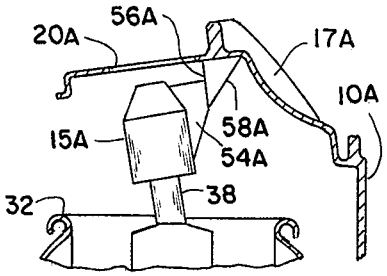
FIG. 12 is a side view of FIG. 11.

FIGS. 9–12 illustrate a second embodiment of the invention with similar component parts utilizing the same numerals followed by the letter "A". In the second embodiment, the actuator button 15A includes a single projection 54A which extends outwardly from the outer side wall of the actuator button 15A. An engaging surface 56A is formed on a protuberance 58A extending from the underside of the finger actuator 17A. FIG. 9 shows the non-selected orientation position wherein the projection 54A is rotated out of alignment with the engaging surface 56A. Upon depressing the finger actuator 17A as shown in FIG. 10, the engaging surface 56A fails to contact the projection 54A or the actuator button 15A. In the selected position shown in FIGS. 11 and 12, the projection 54A is rotated into alignment with the engaging surface 56A. Upon depression of the finger actuator 17A as shown in FIG. 12, the engaging surface 56A contacts projection 54A to tilt the actuator button 15A and dispense product and propellant through aperture 20A.

Figure 13:
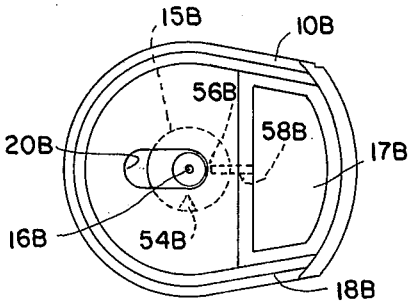
FIG. 13 is a plan view of a third embodiment shown in a non-selected orientation.
Figure 14:
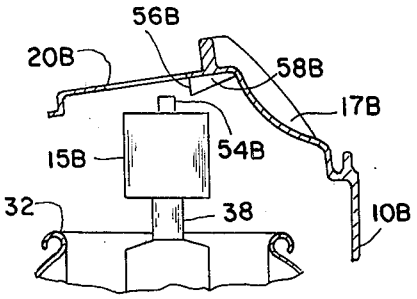
FIG. 14 is a side view of FIG. 13.

FIGS. 13–16 show a third embodiment of the invention, similar parts being labeled by similar reference numerals followed by the letter "B". In this embodiment, a projection 54B is disposed on the upper surface of the actuator button 15B with the engaging surface 56B being located on a protuberance 58B on the underside of the finger actuator 17B. The apparatus operates in a very similar manner to the inventions heretofore described. In FIG. 13, the non-selected orientation results in a failure of contact between the engaging surface 56B and the projection 54B as shown in FIG. 14 upon depression of the finger actuator 17B.

Figure 15:
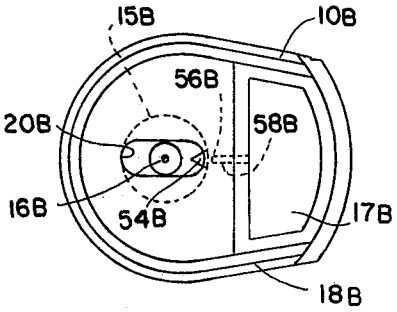
FIG. 15 is a plan view of the third embodiment in the selected orientation.
Figure 16:
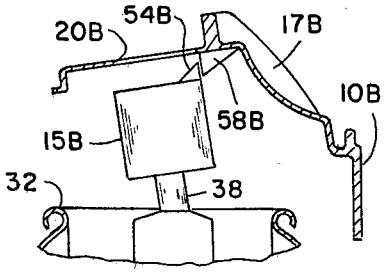
FIG. 16 is a side view of FIG. 15.

FIG. 15 illustrates the selected orientation when the projection 54B is aligned with the engaging surface 56B. Upon depression of the finger actuator 17B product and propellant is dispensed through aperture 20B as shown in FIG. 16.

Figure 17:
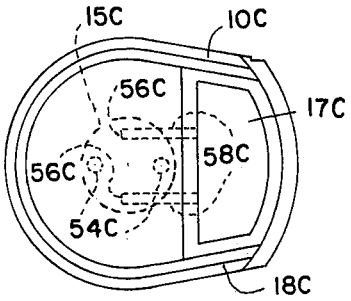
FIG. 17 is a plan view of a fourth embodiment of the child resistant assembly in a non-selected orientation.
Figure 19:
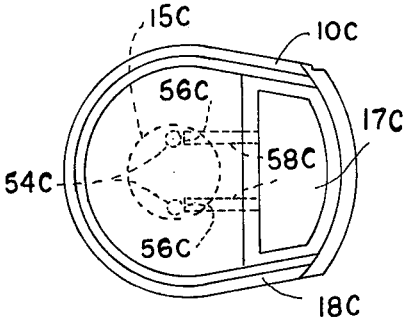
FIG. 19 is a plan view of the fourth embodiment shown in a selected orientation.
Figure 18:
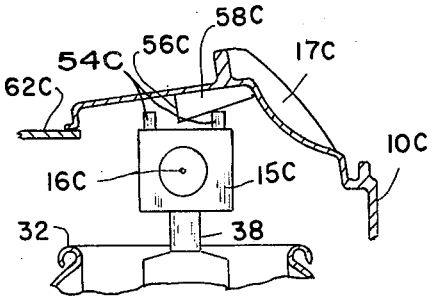
FIG. 18 is a side view of FIG. 17.
Figure 20:
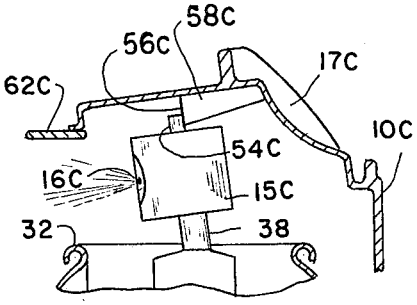
FIG. 20 is a side view of FIG. 19.

FIGS. 17–20 illustrate a fourth embodiment of the invention wherein the invention is incorporated into a horizontal overcap shown partially in FIGS. 18–20. Similar parts are labeled with similar reference numerals followed by the letter "C". In this embodiment, the non-symmetrical means compries plural projections 54C shown as cylinders extending from the upper portion of the actuator button 15C. The engaging surface comprises plural surfaces 56C formed by protuberances 58C. FIG. 17 shows the non-selected orientation wherein the projections 54C are received between the engaging surfaces 56C of protuberances 58C upon depression of the finger actuator 17C as shown in FIG. 18. Accordingly, the actuator button 15C remains stationary in the non-selected oriented.

FIG. 19 illustrates the selected orientation wherein the engaging surfaces 56C are disposed adjacent the projections 54C. Upon depression of the finger actuator 17C as shown in FIG. 20, the engaging surfaces 56C contact projections 54C to tilt the valve stem 38C of the actuator button 15C. Accordingly, product and propellant are dispensed through the horizontal terminal orifice 16C. A stop 62C may be utilized in this or the other embodiments to limit the downward deflection of the finger actuator 17C. The need for such a stop depends on the particular design configuration.

FIGS. 21 and 22 shown an embodiment of a vertically actuated valve which is suitable for use with the present invention. It should be appreciated that this invention may incorporate the horizontal or vertical overcap with either the tilt or vertical actuator valve. Although several specific forms of valves have been disclosed in this specification, it is to be understood that this disclosure is made for clarity and the invention should not be limited to the specific types of valve structures incorporated herein.

The valve assembly shown herein includes a valve body 22A having a body cavity 24A formed on the interior thereof. A tail piece 26A is attached to a dip tube 30A disposed in fluid communication between the interior of the aerosol container 12 and the body cavity 24A. The valve body 22A is mounted on a conventional turret 32A with a sealing gasket 34A disposed in sealing engagement about the upper periphery 36A of the valve body 22A. The valve stem 38A has a base portion 40A for sealing engagement with the gasket 34A as shown in FIG. 21. The stem 38A has a through aperture 42A extending through a metering aperture 43A in the side wall of the stem 38A. A spring 50A biases the base 40A in sealing engagement with the sealing gasket 34A as shown in FIG. 21.

FIG. 22 illustrates vertical depression of the valve stem 38A resulting in the base 40A breaking a seal with the sealing gasket 34A allowing product and propellant to flow through metering aperture 43A to flow through the aperture 42 in the valve stem. The valve assembly shown in FIGS. 21 and 22 may be utilized with either the vertical or horizontal overcap and is specifically shown in the horizontal overcap assembly in FIGS. 23–29.

FIGS. 23–29 show various views of a horizontal embodiment of the present invention utilizing a vertical actuator valve. It should be understood that either the vertical or horizontal overcap configuration may utilize the tilt or vertical actuator valve assembly. The horizontal child resistant assembly comprises an overcap 110 affixed to the upper rim 114 of an aerosol container 122. The overcap 110 covers an actuator button 115 having a terminal orifice 116 more clearly shown in FIG. 28. A finger actuator 117 is located in a finger recess 118 of the overcap 112. An engaging surface shown as a projection 121 extends from the underside of the finger aperture 117 for engaging a non-symmetrical means, shown as a protuberance 122 extending from the top of actuator button 115. The overcap comprises a front recess 124 having a recess orifice 126 located adjacent the terminal orifice 116 of the actuator button enabling a horizontal spray to be discharged substantially perpendicular to the axis of the aerosol container 112.

Figure 25:
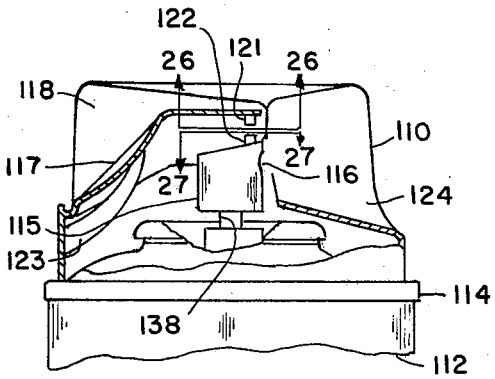
FIG. 25 is a side view partially in section of the horizontal overcap assembly shown in FIGS. 23 and 24.
Figure 26:
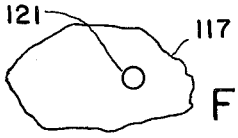
FIG. 26 is a view along line 26—26 in FIG. 25.
Figure 27:
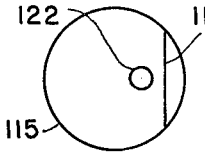
FIG. 27 is a view along line 27—27 in FIG. 25.

FIG. 25 is a side view partially in section of the container shown in FIGS. 23 and 24 with more specific details of the projection 121 and the protuberance 122 shown more clearly in FIGS. 26 and 27. In this embodiment, the projection and the non-symmetrical means takes the shape of a cylinder resulting in a single selected orientation therebetween.

Figure 28:
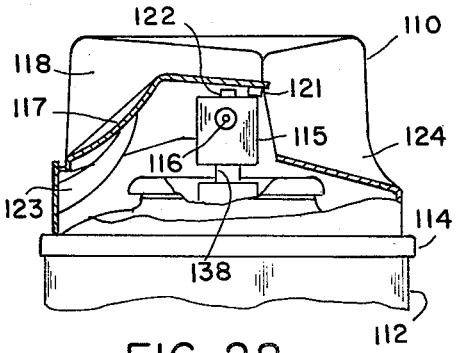
FIG. 28 is a side view partially in section showing the depression of the finger actuator in a non-selected orientation.
Figure 29:
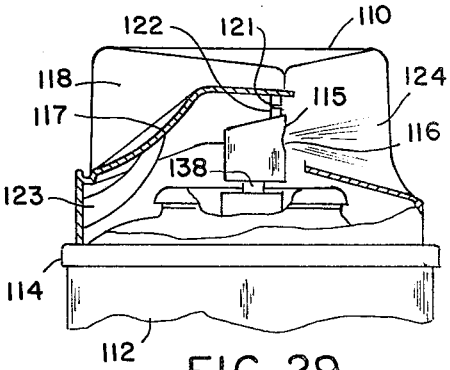
FIG. 29 shows the activation of the child resistant assembly in the selected orientation.

FIG. 28 illustrates the depression of the finger actuator 117 when the actuator button is in a non-selected orientation. Movement of the finger actuator 117 causes projection 121 to avoid contact with protuberance 122 resulting in no depression of valve stem 138 and no discharge of product and propellant. A stop 123 extends from overcap 110 to limit the downward movement of finger actuator 117. It should be understood that stop 123 may take various forms and the invention should not be limited to the disclosed embodiment. FIG. 29 demonstrates the vertical depression of the valve stem 138 and the actuator button 115 upon depression of the finger actuator 117 when the valve button 115 is in the selected orientation relative to the overcap 110. The projection 121 engages protuberance 122 enabling the force of actuator 117 to vertically depress the valve button 115. It should be appreciated that the horizontal configuration results in a double safety feature for this child proof container. The first child proof feature resides in the fact that a non-selected orientation between the actuator button 115 and the finger actuator 117 will cause no vertical depression of the valve button since the projection 121 fails to contact the protuberance 122. The second safety feature embodied in the horizontal version is that the terminal orifice 116 is rotated away from the recess orifice 126 in the non-selected orientation. Accordingly, even in the remote possibility of a malfunction of the stop 123 in the non-selected orientation, any direct spray will be contained within the horizontal overcap 110.

The foregoing has set forth a novel child resistant assembly which is adaptable to either a horizontal or a vertical overcap with either a vertical actuator or tilt valve assembly. The novel configuration resides in part in the simplicity of operation and the simplicity of the parts required to fabricate the assembly. The embodiments shown herein do not require any additional component parts from a conventional aerosol overcap assembly. Furthermore, the invention does not require any orientation of the valve button relative to the overcap assembly. Since the insertion of the valve button and the overcap assembly is generally accomplished at separate places during assembly, the lack of required orientation is extremely desirable to the aerosol industry.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A child resistant assembly for use with an aerosol container having a valve for discharging an aerosol product upon opening the valve, comprising in combination:

an actuator button having a terminal orifice;

a valve stem connecting said actuator button with the valve for enabling discharge of the aerosol product from said terminal orifice upon movement of the valve;

an overcap secured to the aerosol container for at least partially covering said actuator button;

a finger actuator movably mounted relative to said overcap;

an engaging surface disposed on one of said actuator button and said finger actuator for cooperation with non-symmetrical means on the other of said actuator button and said finger actuator; and means for rotationally mounting said finger actuator relative to said actuator button for enabling said engaging surface to contact said non-symmetrical means upon the finger movement of the operator to open the valve only upon selected orientation of said finger actuator relative to said actuator button.

2. A child resistant assembly as set forth in claim 1, wherein said finger actuator is pivotally mounted to said overcap with said pivot axis being displaced from the axis of the valve for moving the valve when said engaging surface contacts said non-symmetrical means.

3. A child resistant assembly as set forth in claim 1, wherein said engaging surface comprises projection means disposed for engaging said non-symmetrical means upon finger movement of the operator during a selected orientation of said finger actuator relative to said actuator button; and said engaging surface avoids said non-symmetrical means upon finger movement of the operator during non-selected orientation of said finger actuator relative to said actuator button.

4. A child resistant assembly as set forth in claim 3, wherein non-symmetrical means comprises protuberance means extending from said other of said actuator button and said finger actuator for providing non-symmetrical dimensions about the axis of the valve.

5. A child resistant assembly as set forth in claim 4, wherein said projection means comprises plural spaced apart projections for engaging said protuberance means upon a selected orientation between said finger actuator and said actuator button; and said plural projections receiving said protuberances between said plural spaced apart projections upon non-selected orientations of said finger actuator and said actuator button.

6. A child resistant assembly as set forth in claim 1, wherein said finger actuator is an integral member with said overcap; and said finger actuator being pivotably mounted relative to said overcap through an integral hinge.

7. A child resistant assembly as set forth in claim 1, wherein said engaging surface is disposed in said finger actuator; and said non-symmetrical means comprises an outer configuration of said actuator button.

8. A child resistant assembly as set forth in claim 7, wherein said non-symmetrical means comprises the outer circumferential surface of said actuator button.

9. A child resistant assembly as set forth in claim 7, wherein said engaging surface comprises projection means extending from the underside of said finger actuator for engaging said outer surface of said actuator button only during selected orientation between said finger actuator and said actuator button.

10. A child resistant assembly as set forth in claim 1, wherein said engaging surface comprises projection means extending from the underside of said finger actuator;

said non-symmetrical means comprising a protuberance extending from said actuator button;

said projection means engaging said protuberance for transferring the finger movement of the operator to move the valve upon selected orientation between said finger actuator and said actuator button; and said projection means avoiding said protuberance upon finger movement of the operator during non-selected orientation between said finger actuator and said actuator button.

11. A child resistant assembly for use with an aerosol container having a tilt valve for discharging aerosol product upon tilting the valve, the improvement comprising in combination:

an actuator button having a terminal orifice;

a valve stem connecting said actuator button with the valve for discharging the aerosol product through said terminal orifice upon movement of the valve;

an overcap rotatably secured to said aerosol container for at least partially covering said actuator button;

a finger actuator pivotably mounted to said overcap with the axis of said pivot being displaced from the axis of the valve;

an engaging surface disposed on one of said actuator button and said finger actuator for cooperation with non-symmetrical means in the other of said actuator button and said finger actuator;

said engaging surface contacting said non-symmetrical means to transfer the finger movement of the operator to move the valve only upon selected orientation of said finger actuator relative to said actuator button; and said engaging surface avoiding said non-symmetrical means to prevent movement of the valve during finger movement of the operator upon non-selected orientation of said finger actuator relative to said actuator button.

12. A child resistant assembly as set forth in claim 11, wherein said overcap comprises an orifice disposed in a side wall of said overcap with said terminal orifice of said actuator button disposed adjacent said side wall orifice for discharging the aerosol product through said side wall orifice in a direction substantially perpendicular to the axis of the aerosol container.

13. A child resistant assembly as set forth in claim 11, wherein said overcap comprises an orifice disposed in said finger actuator with said terminal orifice of said actuator button disposed adjacent said finger actuator for discharging the aerosol product through said finger actuator orifice in a direction substantially parallel to the axis of the aerosol container.

14. A child resistant assembly as set forth in claim 11, including stop means for limiting the extent of movement of said finger actuator relative to said overcap.

* * * * *